US008120545B2

(12) United States Patent
Tang et al.

(10) Patent No.: US 8,120,545 B2
(45) Date of Patent: Feb. 21, 2012

(54) MULTIFUNCTIONAL ANTENNA CHIP

(75) Inventors: Chia-Lun Tang, Pa-Te (TW); Shih-Chi Lai, Pa-Te (TW)

(73) Assignee: Auden Techno Corp., Pa-Te, Tao-Yuan Hsien (TW)

( * ) Notice: Subject to any disclaimer, the term of this patent is extended or adjusted under 35 U.S.C. 154(b) by 410 days.

(21) Appl. No.: 12/542,093

(22) Filed: Aug. 17, 2009

(65) Prior Publication Data

US 2011/0037678 A1 Feb. 17, 2011

(51) Int. Cl.
*H01Q 1/50* (2006.01)

(52) U.S. Cl. ..... 343/860; 343/700 MS; 343/702

(58) Field of Classification Search ..... 343/700 MS, 343/702, 850, 860, 861
See application file for complete search history.

(56) References Cited

U.S. PATENT DOCUMENTS

| | | | | |
|---|---|---|---|---|
| 5,386,214 | A * | 1/1995 | Sugawara | 343/700 MS |
| 5,912,647 | A * | 6/1999 | Tsuru et al. | 343/700 MS |
| 6,166,705 | A * | 12/2000 | Mast et al. | 343/853 |
| 6,462,716 | B1 * | 10/2002 | Kushihi | 343/860 |
| 7,102,587 | B2 * | 9/2006 | Benton et al. | 343/873 |
| 7,242,364 | B2 * | 7/2007 | Ranta | 343/860 |
| 7,733,278 | B2 * | 6/2010 | Kanasaki et al. | 343/702 |

* cited by examiner

*Primary Examiner* — Tho G Phan
(74) *Attorney, Agent, or Firm* — Guice Patents PLLC

(57) ABSTRACT

A multifunctional antenna chip is able to mate with many kinds of matched circuits and is able to adjust the character of an antenna structure of the multifunctional antenna chip, in order that the antenna structure has one or multiple standard working frequencies. The antenna structure is a folded antenna structure basically; this can save its volume occupied. And the multifunctional antenna chip has a non-signal inputting pin for connection to thereby increase shape of the antenna for adjusting the style of the antenna structure designed.

6 Claims, 14 Drawing Sheets

The VSWR result of the antenna

Marker 1. = 824MHz Marker 2. = 960MHz

Marker 3. = 1710MHz Marker 4. = 2170MHz

Marker 1.=2400MHz Marker 2.=2500MHz

Marker 3.=5000MHz Marker 4.=5800MHz

Marker 1. = 1575.42MHz

MULTIFUNCTIONAL ANTENNA CHIP

BACKGROUND OF THE INVENTION

1. Field of the Invention

The present invention relates to a multifunctional antenna chip, and especially to an antenna chip which can be mated with many kinds of matched circuits and is able to adjust the character of an antenna structure of the multifunctional antenna chip, in order that the antenna structure has one or multiple standard working frequencies.

2. Description of the Prior Art

By fast development of the wireless communication technique, the kinds of standard specifications of present world communication are numerous, for instance, they include the standards of PCS, GSM, WCDMA, WLAN, Bluetooth, EDGE, DCS, CDMA, HSPA, UMTS, GPS, GPRS, WiMAX, HSPA, WiFi etc.

As to the operational frequency bands, they include several standard specifications such as the European specification, American specification etc. It is often that in selling a kind of mobile phone to all around the world, an antenna is designed to include all frequency bands. And it is often that such antennas need longer developing time and larger costs, or need to be designed in pursuance of respective local standards of frequency band; however, a situation is there that many antennas are supposed to be studied and developed, this not only increases costs and developing time, but also creates pressure of inventory.

The present invention provides a brand new idea of design and application of antennas, one multifunctional antenna chip can be used to mate with many kinds of matched circuits according to a desired communication standard to meet the requirement of multiple functions.

SUMMARY OF THE INVENTION

The present invention provides a multifunctional antenna chip which can be mated with many kinds of matched circuits, and is able to adjust the character of an antenna structure of the multifunctional antenna chip, in order that the antenna structure has one or multiple standard working frequencies. The antenna structure is a folded antenna structure basically; this can save its volume occupied. And the multifunctional antenna chip has a non-signal inputting pin for connection to thereby give the antenna an increased shape for adjusting the style of the antenna structure designed.

The multifunctional antenna chip provided in the present invention makes an antenna a standard antenna which can be applied to various communication standards, and can be mass produced very fast to lower the cost for the portion of designing antenna, and also can reduce pressure of inventory. The present invention is characterized at least in:

1. being a standardized product (to be convenient for designing communication products);
2. being packed on a material tape, and having SMD connecting pins (taking advantage of the mode of SMT, in order that products can be mass produced);
3. flexible application (matched circuits can be used for various communication standards or the antenna structure can be changed for adjusment);
4. completion of product manufacturing being able to be speeded up;
5. the matched circuits being adapted to using various electronic elements (including capacitors, inductors, adjustable capacitors or inductors, switches etc.);

6. four connecting pins being able all of RF signal inputting pins (for the convenience of laying out);
7. being easy to combine with an FPC soft board or a PCB board in a product, the designer of products being able of having quite wide dominance.

The present invention will be apparent in its structure and various applications after reading the detailed description of the preferred embodiment thereof in reference to the accompanying drawings.

DETAILED DESCRIPTION OF THE PREFERRED EMBODIMENT

Figure 1:
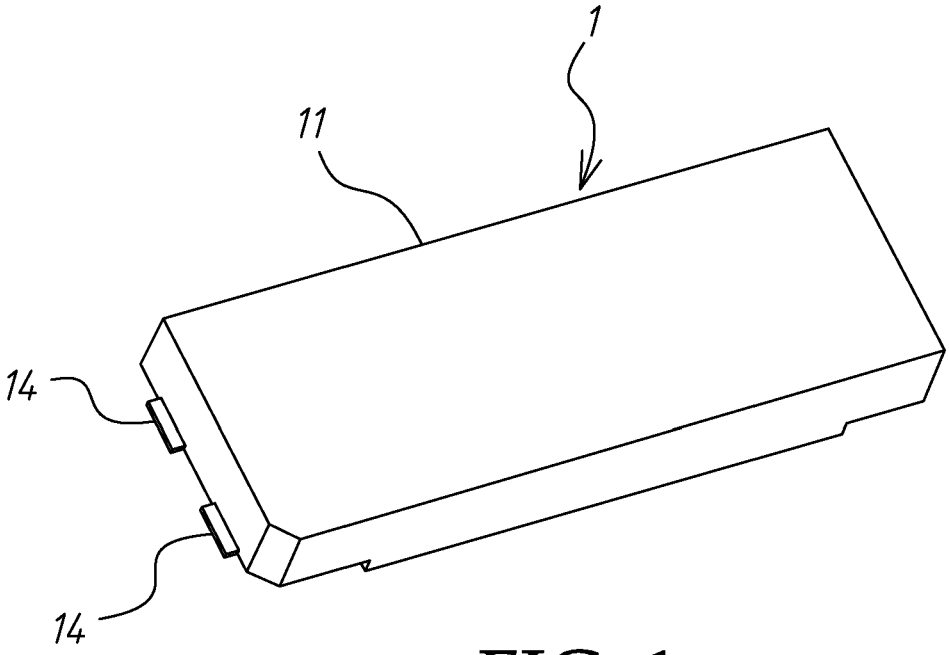
FIG. 1 is a perspective view showing the appearance of the present invention.
Figure 2:
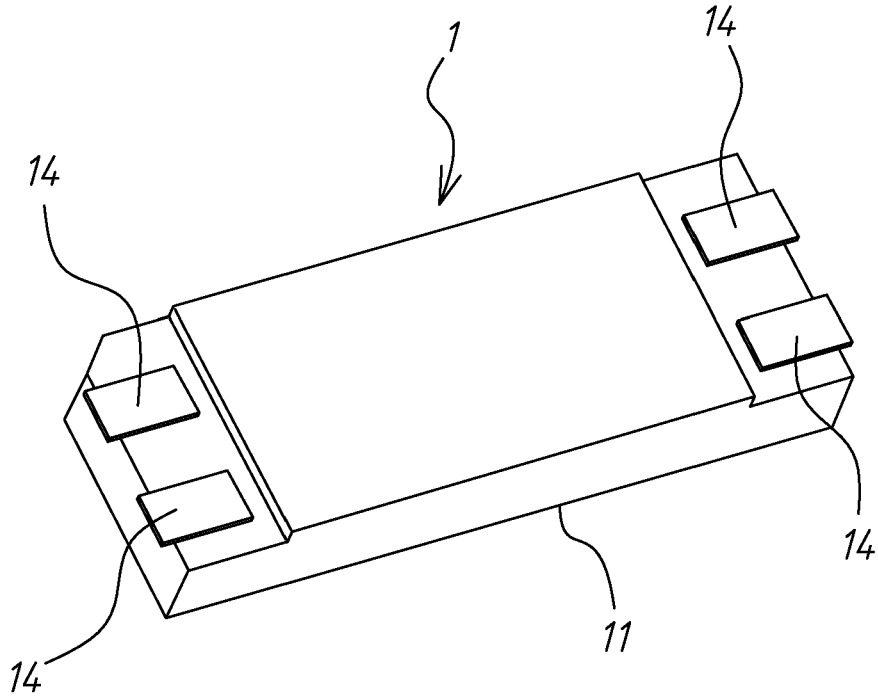
FIG. 2 is a perspective view showing the appearance of the present invention from another angular viewing position.

Referring to FIGS. 1 and 2, the present invention provides a multifunctional antenna chip 1, the multifunctional antenna chip 1 is mounted on an electric circuit board 2 provided with a matched circuit 21 which has thereon a feed-in point 22 for transmitting radio frequency signals.

Referring together to FIGS. 4 to 7, the multifunctional antenna chip 1 of the present invention mainly comprises a packing housing 11, a dielectric layer base board 12, an antenna structure 13 and four connecting pins 14.

The dielectric layer base board 12 is provided in the packing housing 11 and has a plurality of via holes 121. The an antenna structure 13 includes an upper metallic layer 131 and a lower metallic layer 132 respectively allocated on the upper surface and the bottom surface of the dielectric layer base board 12; the upper metallic layer 131 and the lower metallic layer 132 are connected with each other by the via holes 121 to form a folded antenna structure. The four connecting pins 14 are connecting pins for a surface mounting equipment (SMD), they are extended in the dielectric layer base board 12 from the four corners of the packing housing 11 to connect the lower metallic layer 132, but not to connect the upper metallic layer 131.

Figure 3:
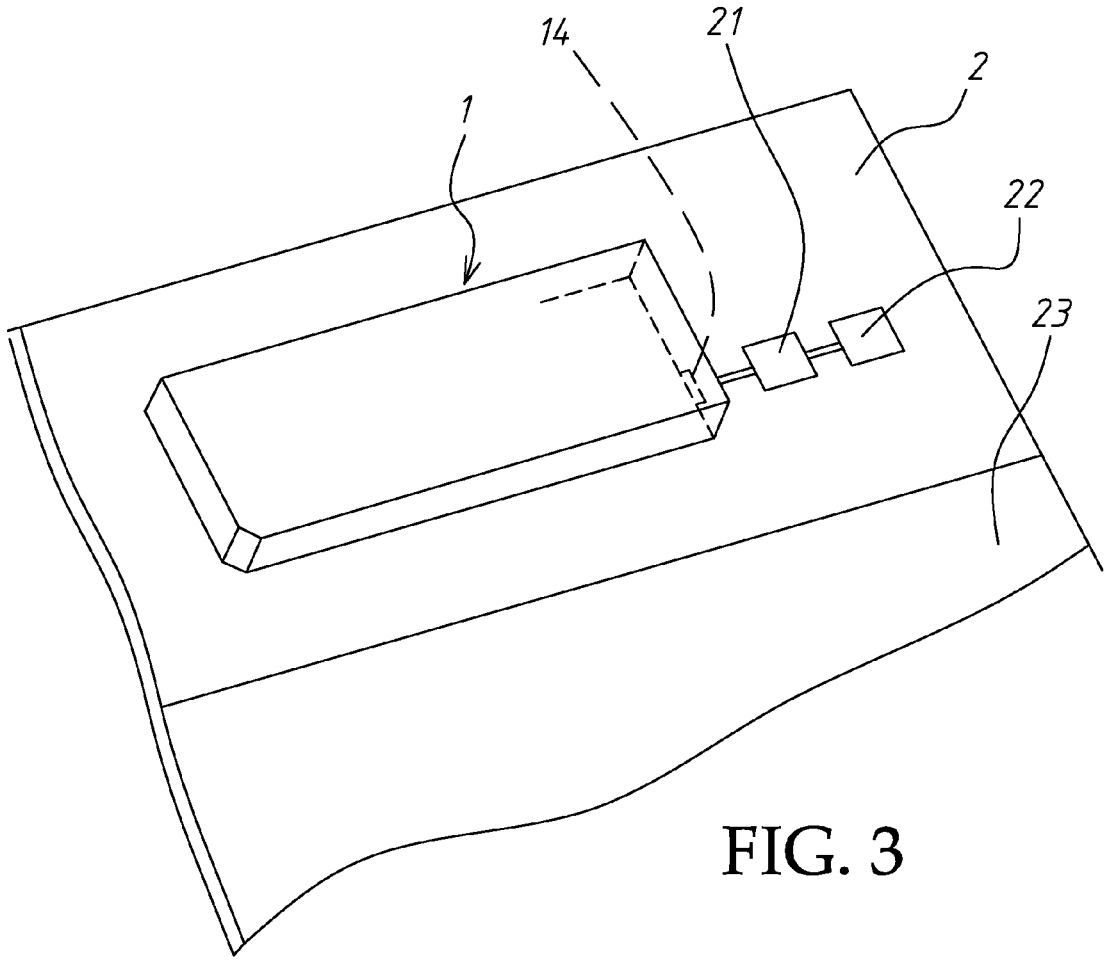
FIG. 3 is a schematic view showing installing of the present invention on an electric circuit board to connect with a matched circuit.
Figure 3A:
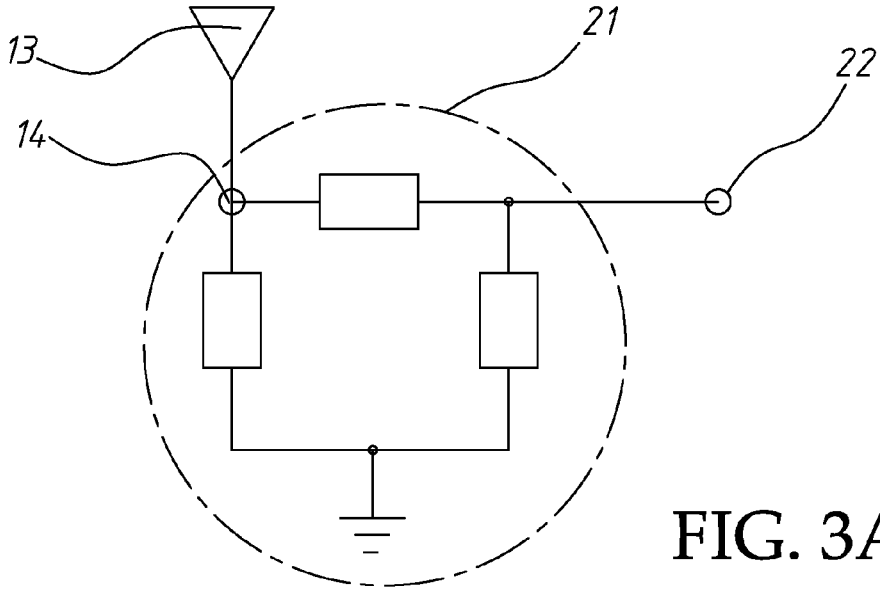
FIG. 3A is a schematic view showing the circuit of FIG. 3.
Figure 4:
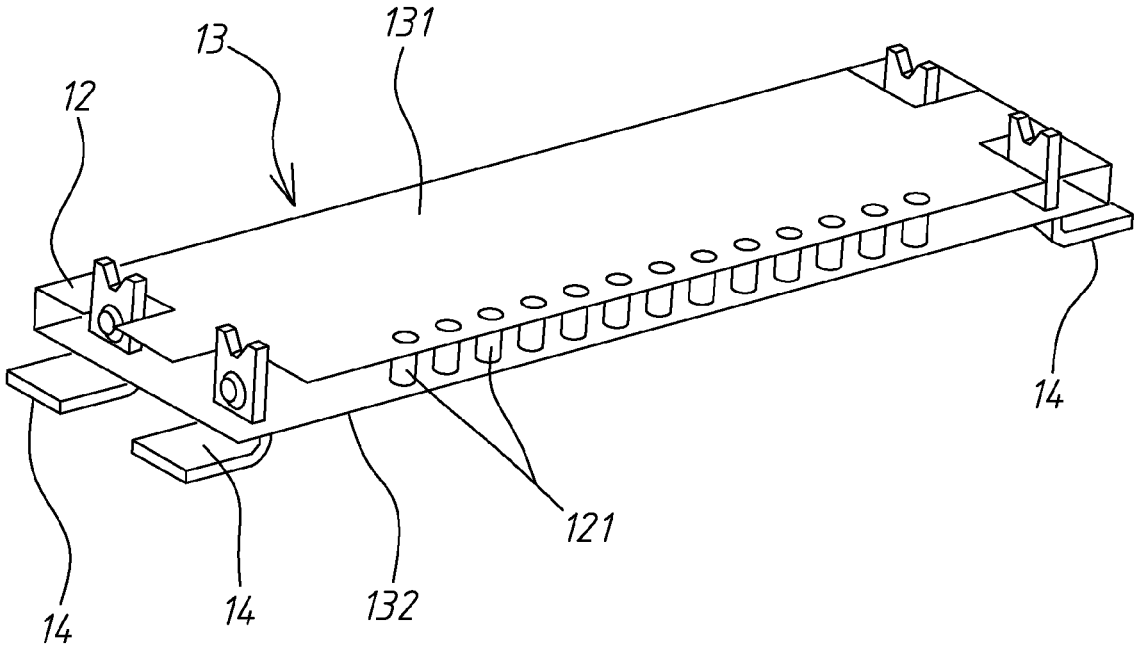
FIG. 4 is a perspective view showing the interior structure of the present invention.
Figure 5:
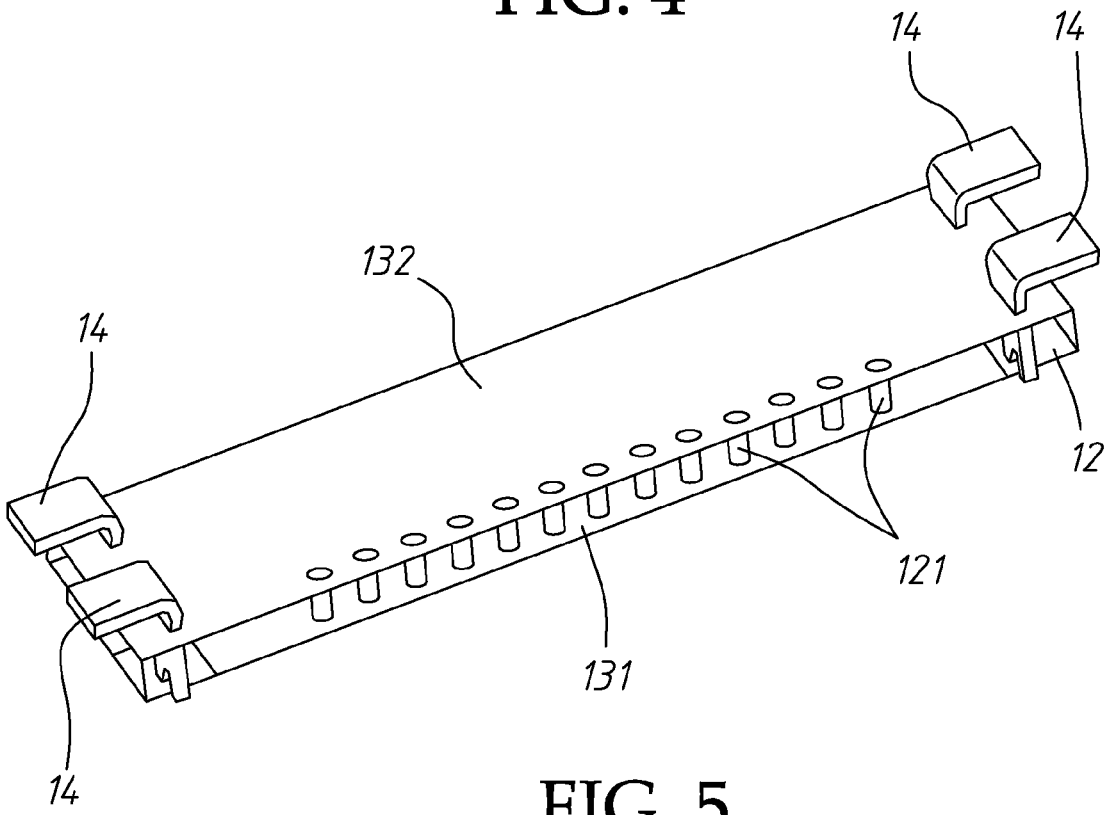
FIG. 5 is a perspective view showing the interior structure of the present invention from another angular viewing position.
Figure 6:
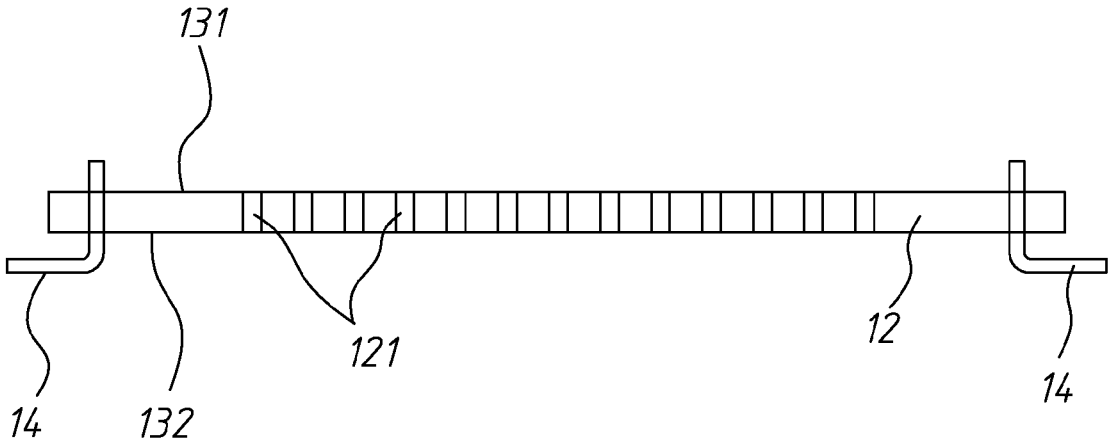
FIG. 6 is a plan view showing the interior structure of the present invention.
Figure 7:
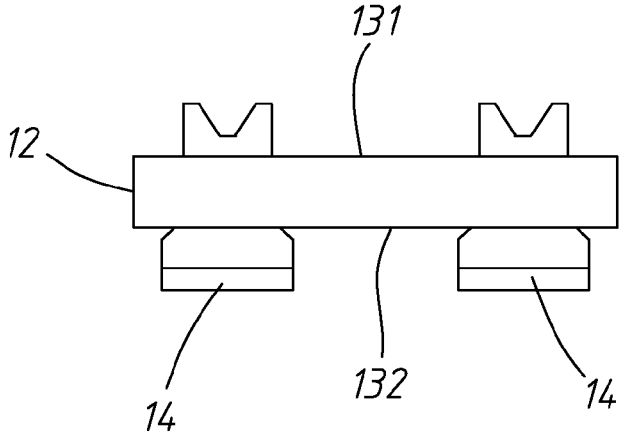
FIG. 7 is a side view showing the interior structure of the present invention.

The multifunctional antenna chip 1 of the present invention has a reduced size, for instance 22.2×7.2×2.55 $mm^3$, it can be mounted on the electric circuit board 2, wherein one of the connecting pins 14 is connected with the matched circuit 21 of the electric circuit board 2 to function as a signal transmitting pin (referring to FIGS. 3 and 3A).

Radio frequency signals are put in from the feed-in point 22, after they pass the matched circuit 21, they enter the antenna structure 13 via the signal input connecting pins 14 to form a mono-pole antenna. The present invention can have the character of the antenna structure 13 adjusted by the matched circuit 21, in order that the antenna structure 13 has a working frequency meeting the standard of communication, for instance: PCS, GSM, WCDMA, WLAN, Bluetooth, EDGE, DCS, CDMA, HSPA, UMTS, GPS, GPRS, WiMAX, HSPA, WiFi etc.

The electronic elements used in the matched circuit which is mated with the multifunctional antenna chip 1 of the present invention can be capacitors, inductances, adjustable capacitors, adjustable inductances or switches etc.

Figure 8:
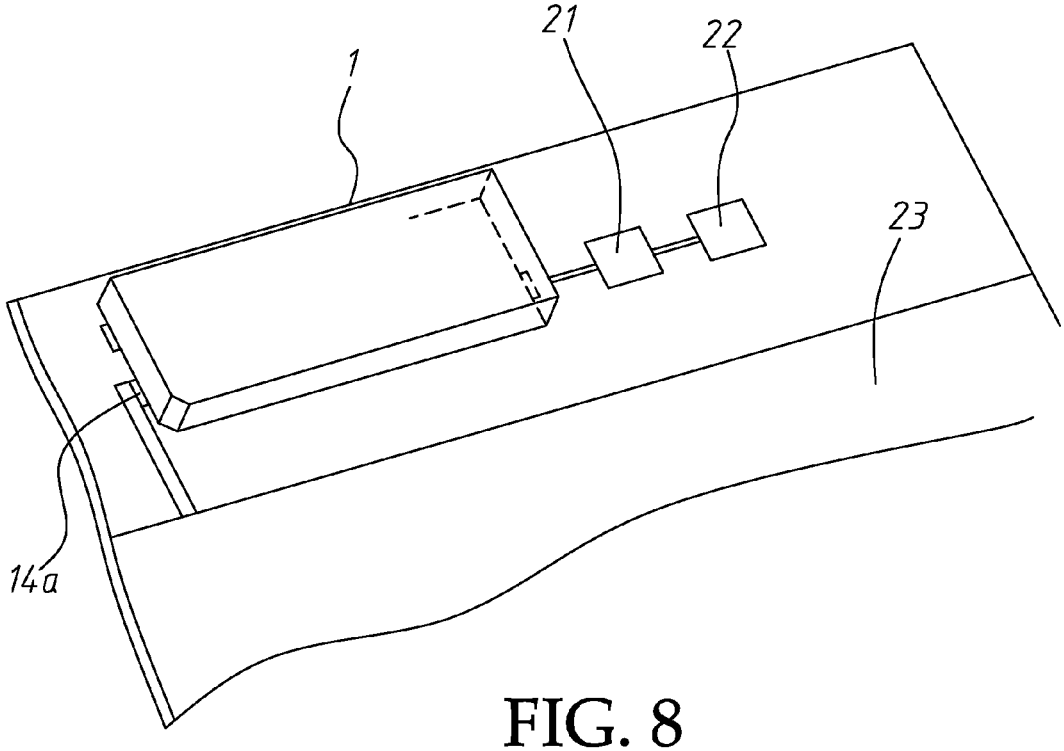
FIG. 8 is a schematic view showing another mode to install the present invention on an electric circuit board to connect with a matched circuit, and to have a non-feed in pin to connect to the ground for forming a PIFA or IFA structure.

Referring to FIG. 8 showing another mode of applying of the present invention, wherein another non-signal inputting connecting pin 14*a* of the multifunctional antenna chip 1 of the present invention is connected to the ground 23 of the electric circuit board 2, this will transform the interior antenna structure 13 into a plane inverted "F" antenna (PIFA) structure or an inverted "F" antenna (IFA) structure, thereby a multifunctional antenna can be attained.

Figure 9:
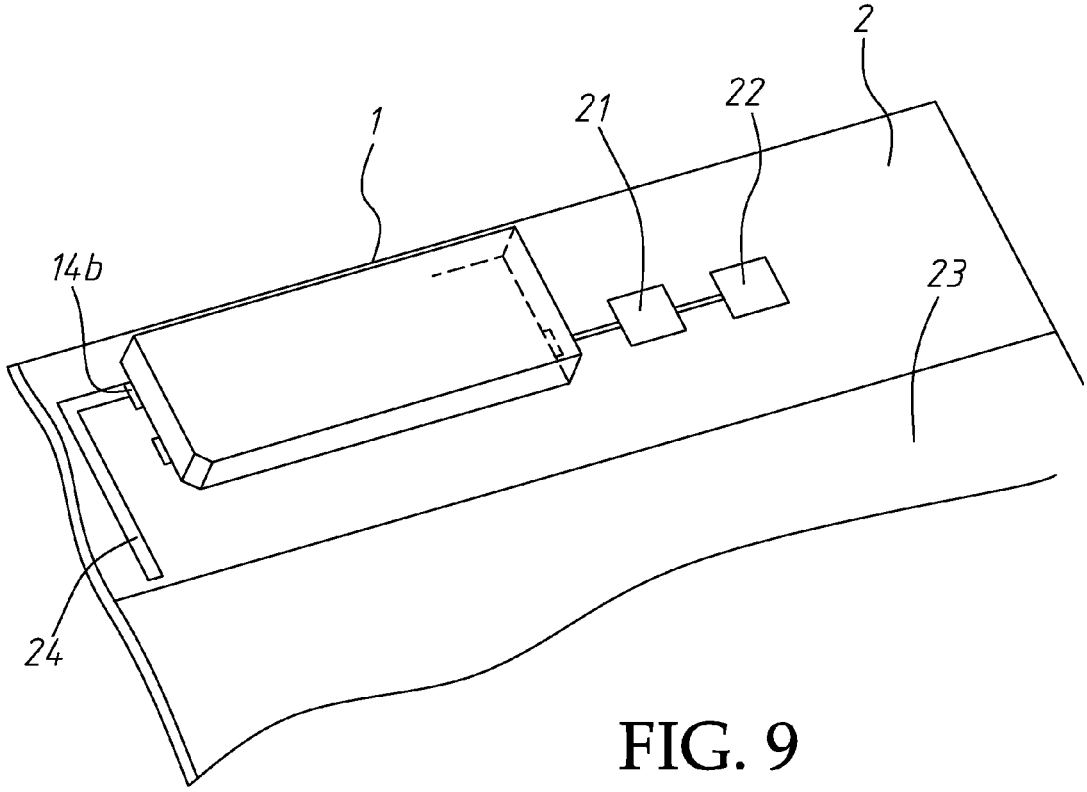
FIG. 9 is a schematic view showing another mode to install the present invention on an electric circuit board to connect with a matched circuit, and to have a non-feeding in pin to connect a metallic wire segment of an antenna.

As shown in FIG. 9 showing a further mode of applying of the present invention, wherein, the electric circuit board 2 is provided thereon with a metallic wire segment 24 of an antenna which is connected to another non-signal inputting connecting pin 14*b* of the multifunctional antenna chip 1 of the present invention to thereby increase the style of the antenna structure, this design also can achieve the object of adjusting working frequency of the antenna structure 13. The metallic wire segment 24 can be of any shape, a user can design by himself to attain the requirement of the character of the antenna; this is same by object as that of the embodiment of FIG. 8, they are both derivative designs of the multifunctional antenna chip of the present invention. And more, FIGS. 8 and 9 show two further modes of applying of the present invention, sometimes after the multifunctional antenna chip is placed in a product and is added with a matched circuit but is unable to completely reach the required specification for the antenna, these two modes can be applied in order to make derivative designs for reaching the required specification for the antenna.

Figure 10:
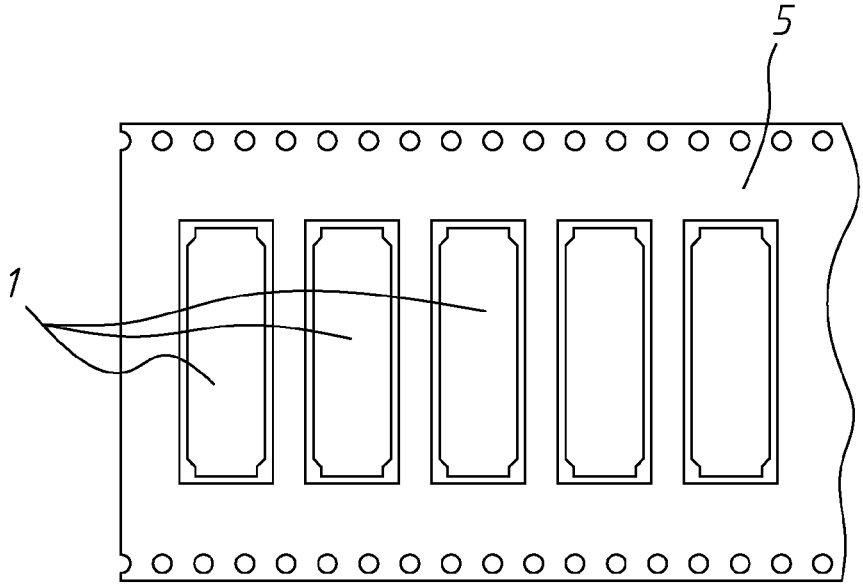
FIG. 10 is a schematic view showing the present invention is provided on a reel taping.

Referring to FIG. 10, by virtue that the connecting pins of the multifunctional antenna chip of the present invention are SMD connecting pins, many multifunctional antenna chips 1 can be provided on a reel taping 5, and can be fast mounted on the electric circuit board 2 by a surface mounting technique.

Figure 11:
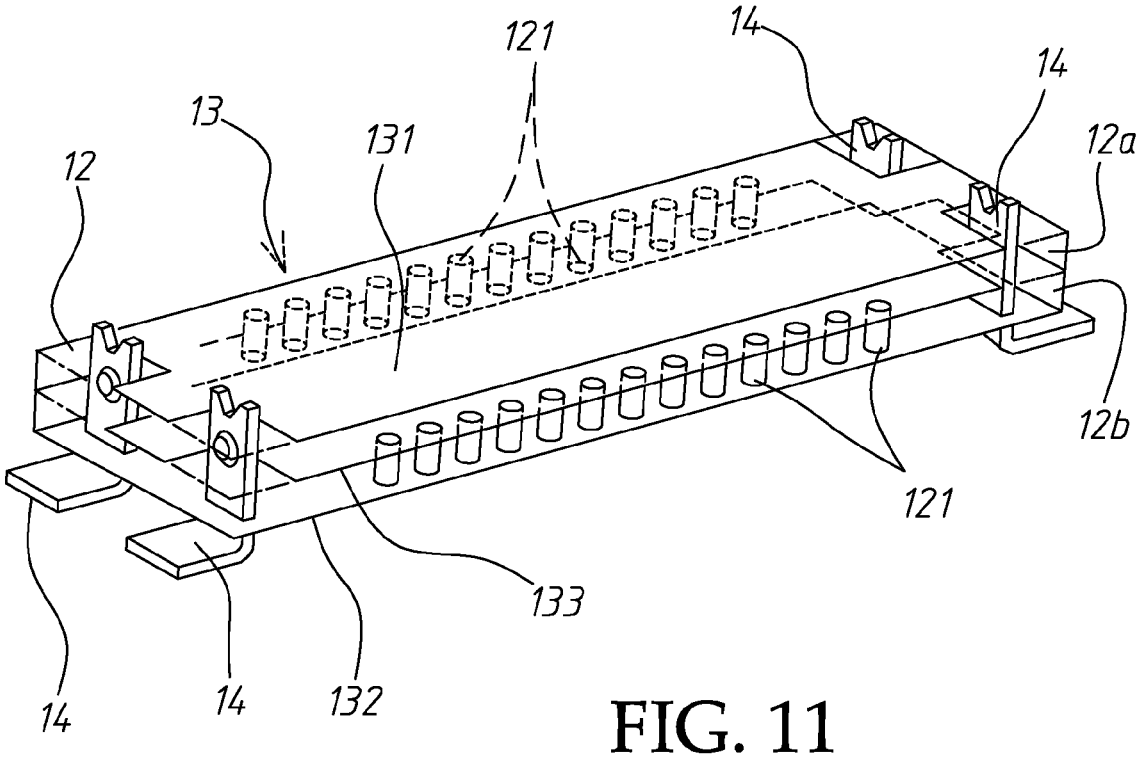
FIG. 11 is a perspective view showing an interior structure of the present invention with mutually piled multiple layers.

Referring to FIG. 11 showing another example of the multifunctional antenna chip of the present invention, wherein multiple layers of dielectric layer base boards 12*a*, 12*b* are piled, every two dielectric layer base boards 12*a*, 12*b* have therebetween a middle metallic layer 133, the two dielectric layer base boards 12*a*, 12*b* are connected by means of a plurality of via holes 121 with the upper metallic layer 131 and the lower metallic layer 132 respectively.

Figure 12:
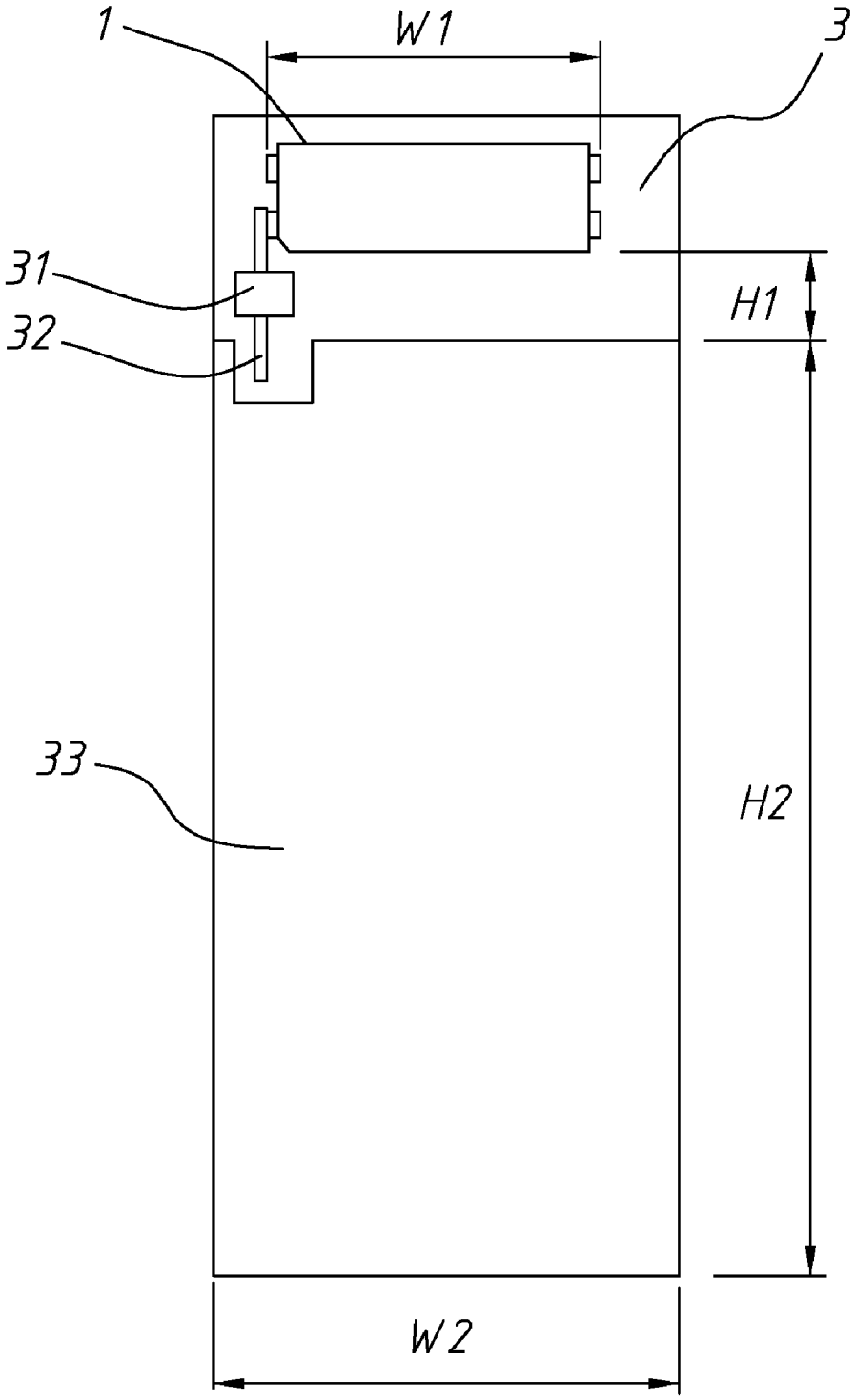
FIG. 12 is a schematic view showing an example that the present invention is used in a mobile phone.
Figure 13:
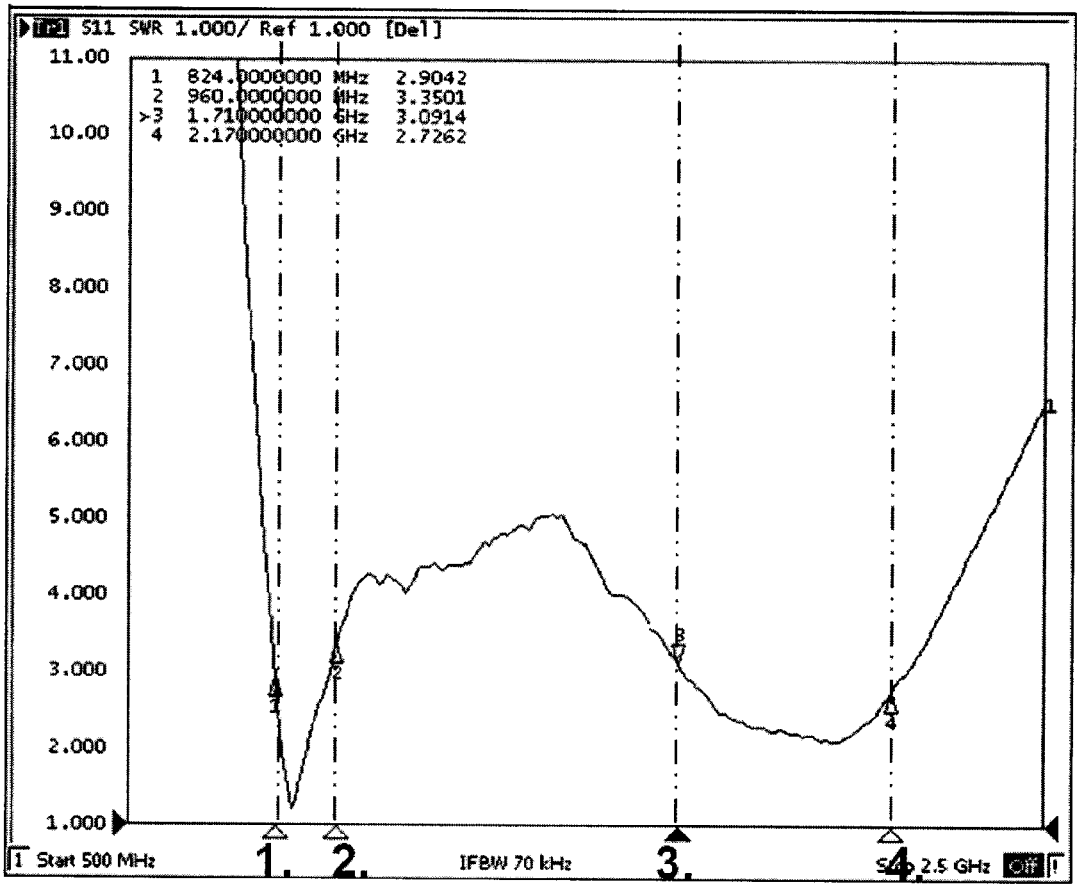
FIG. 13 is a chart showing a standing wave voltage ratio curve of a tested antenna in FIG. 12.

FIG. 12 shows an example that the present invention is used in a mobile phone, wherein a multifunctional antenna chip 1 has a 22.2 mm width W1 and is installed on an electric circuit board 3 having thereon an LC matched circuit 31; the electric circuit board 3 has a ground 33 with a width and a height respectively of 40 mm and 90 mm; the distance H1 from the multifunctional antenna chip 1 to the ground 33 is 5~8 mm; a micro strip 32 provided is a 50Ω feed-in strip. With such arrangement, a monopole antenna is formed. FIG. 13 is a chart showing a standing wave voltage ratio curve of the example of FIG. 12; it shows that frequencies between 824~960 MHz and 1710~2170 MHz are good working frequencies for an antenna. The passive efficiencies for them are as follows:

| 824 MHz GSM Test | | | | | | | |
|---|---|---|---|---|---|---|---|
| | Frequency | | | | | | |
| | 824 | 836 | 849 | 869 | 880 | 894 | 900 |
| Directivity (dBi) | 3.318 | 3.357 | 3.353 | 3.376 | 3.259 | 3.35 | 3.423 |
| Peak EIRP (dBm) | −0.555 | −0.362 | −0.405 | −0.002 | 0.165 | −0.077 | 0.007 |
| Efficiency (%) | 40.98% | 42.46% | 42.09% | 45.94% | 49.05% | 45.44% | 45.39% |

| 960 MHz GSM Test | | | | | | | |
|---|---|---|---|---|---|---|---|
| | Frequency | | | | | | |
| | 915 | 925 | 940 | 960 | 1710 | 1750 | 1785 |
| Directivity (dBi) | 3.456 | 3.332 | 3.304 | 3.579 | 4.142 | 4.166 | 4.21 |
| Peak EIRP (dBm) | −0.047 | 0.153 | −0.025 | 0.031 | 0.747 | 1.731 | 1.78 |
| Efficiency (%) | 44.64% | 48.10% | 46.46% | 44.18% | 45.75% | 57.10% | 57.15% |

| 1710 MHz GSM Test | | | | | | | |
|---|---|---|---|---|---|---|---|
| | Frequency | | | | | | |
| | 1805 | 1840 | 1850 | 1880 | 1910 | 1920 | 1930 |
| Directivity (dBi) | 4.294 | 4.372 | 4.268 | 4.274 | 4.404 | 4.385 | 4.335 |
| Peak EIRP (dBm) | 2.267 | 2.189 | 1.917 | 2.206 | 2.285 | 2.475 | 2.667 |
| Efficiency (%) | 62.70% | 60.49% | 58.21% | 62.12% | 61.38% | 64.42% | 68.09% |

| 2170 MHz GSM Test | | | | | | | |
|---|---|---|---|---|---|---|---|
| | Frequency | | | | | | |
| | 1950 | 1960 | 1980 | 1990 | 2110 | 2140 | 2170 |
| Directivity (dBi) | 4.339 | 4.335 | 4.242 | 4.169 | 3.444 | 3.369 | 3.341 |
| Peak EIRP (dBm) | 2.658 | 2.834 | 2.373 | 2.601 | 0.663 | 0.339 | 0.36 |
| Efficiency (%) | 67.90% | 70.78% | 65.03% | 69.68% | 52.71% | 46.76% | 50.34% |

Figure 14:
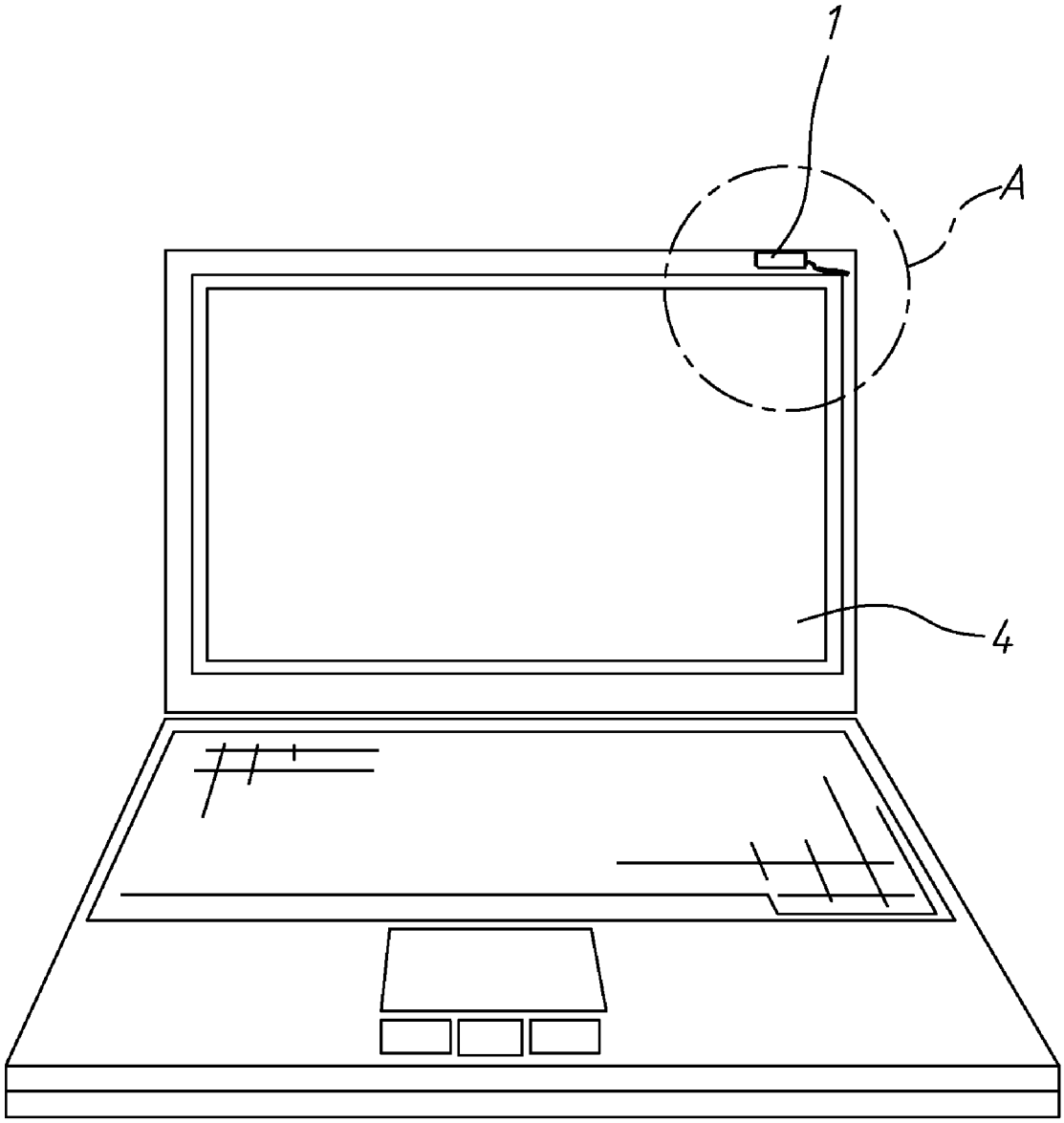
FIG. 14 is a perspective view showing an example that the multifunctional antenna chip of the present invention is mounted in a monitor of a notebook to be applied to WLAN.
Figure 14A:
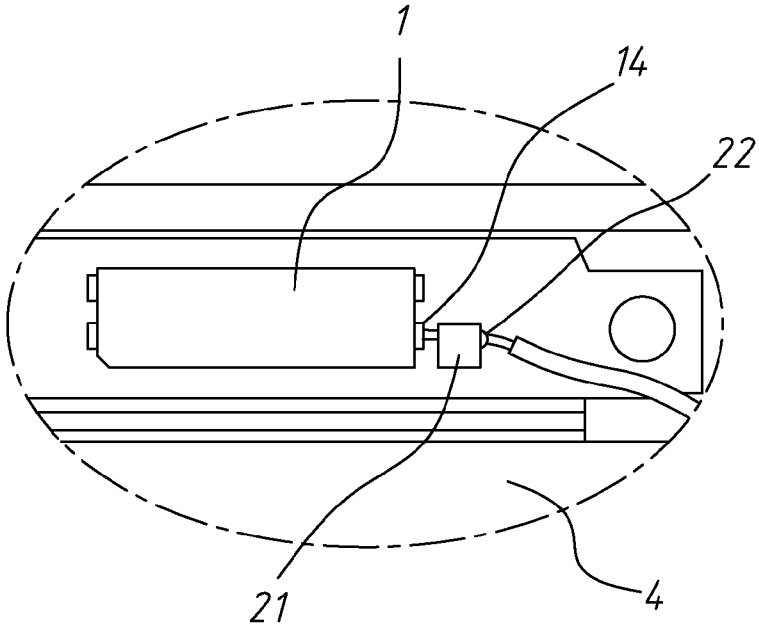
FIG. 14A is a partial enlarged schematic view taken from FIG. 14.
Figure 14B:
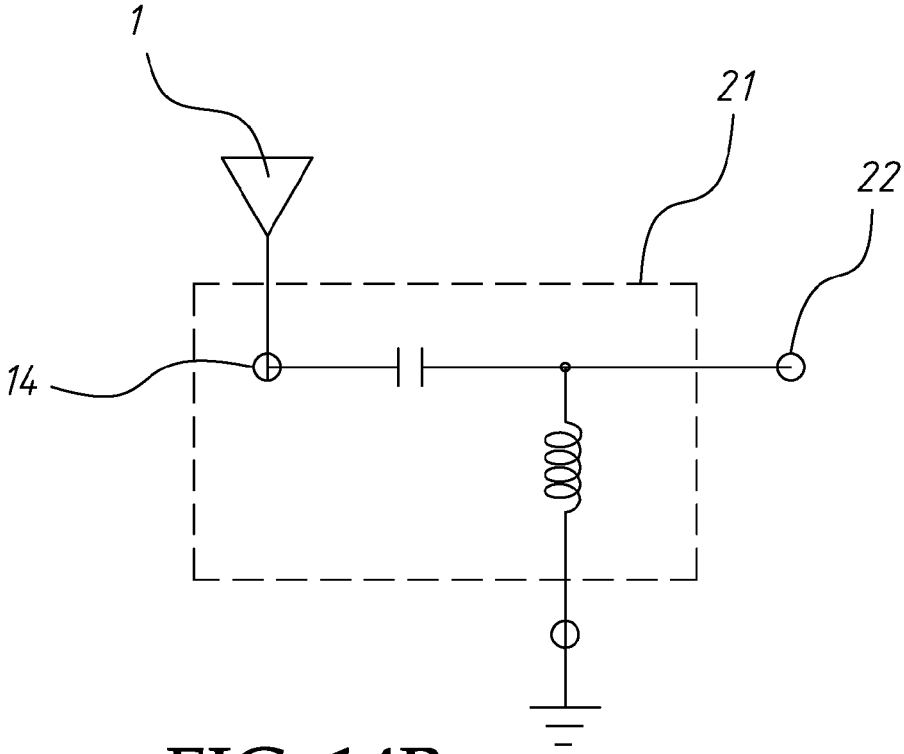
FIG. 14B is a chart showing an electric circuit of FIG. 14.
Figure 15:
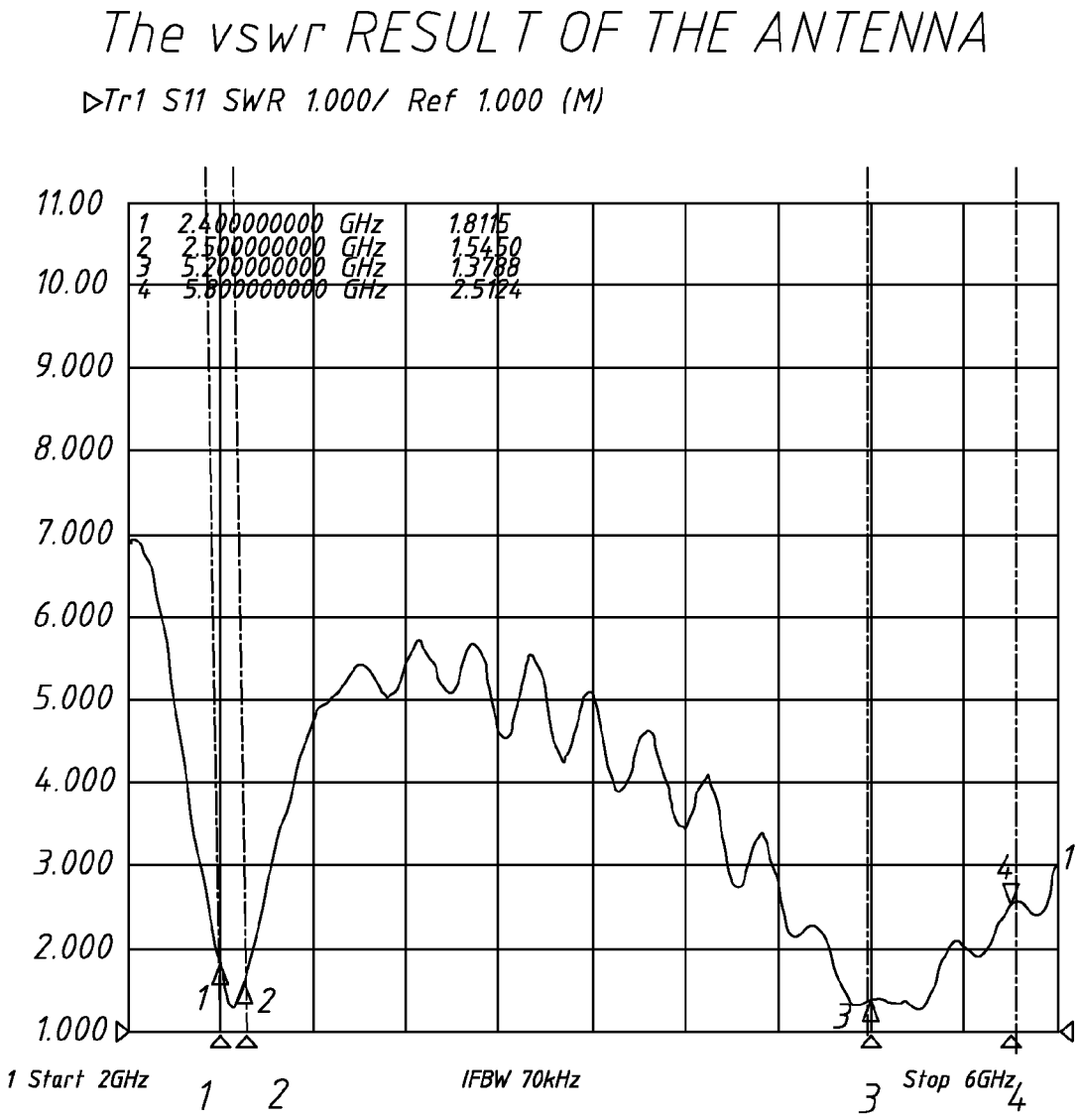
FIG. 15 is a chart showing a standing wave voltage ratio curve of a tested antenna in FIG. 14.
Figure 16:
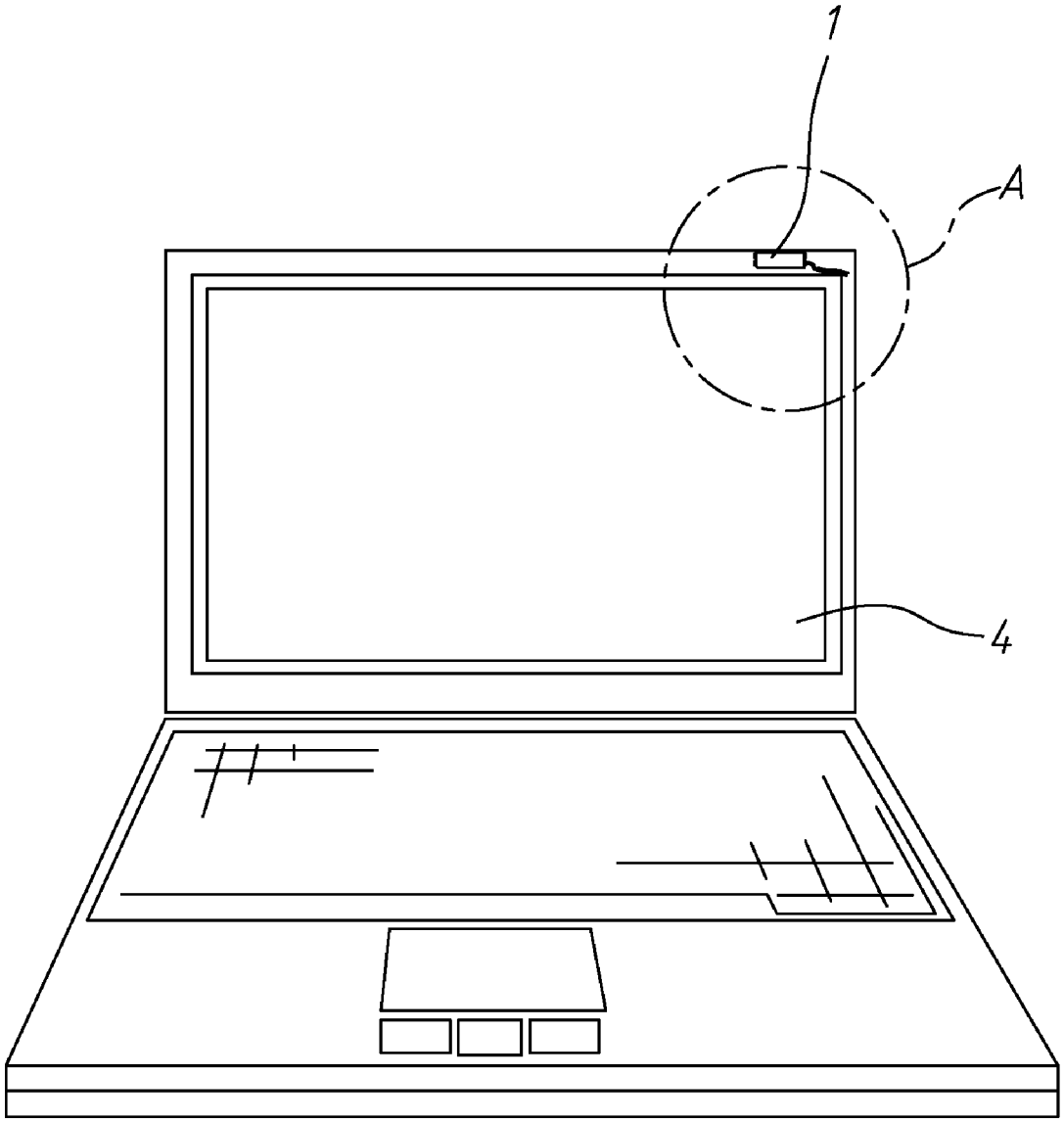
FIG. 16 is a perspective view showing an example that the multifunctional antenna chip of the present invention is mounted in a monitor of a notebook to be applied to GPS.
Figure 16A:
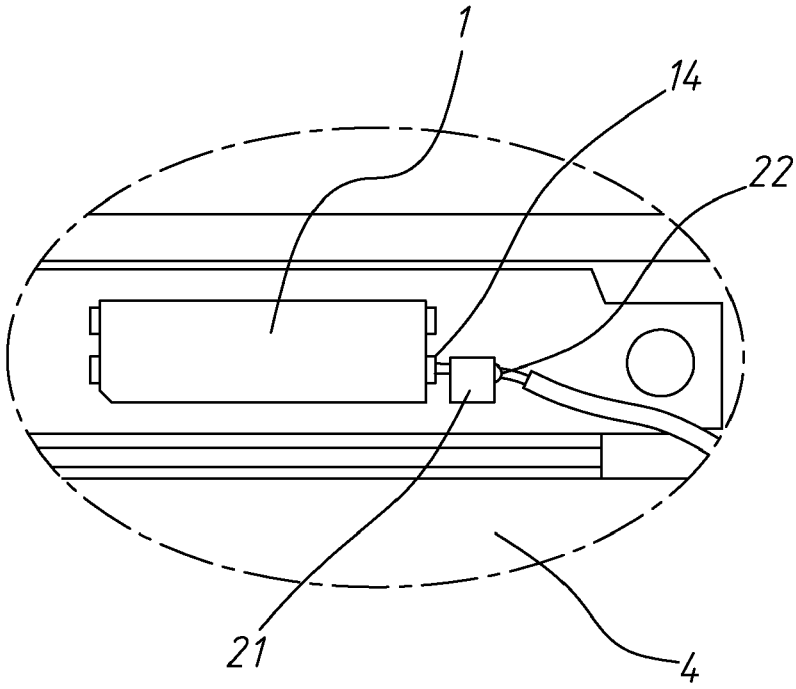
FIG. 16A is a partial enlarged schematic view taken from FIG. 16.
Figure 16B:
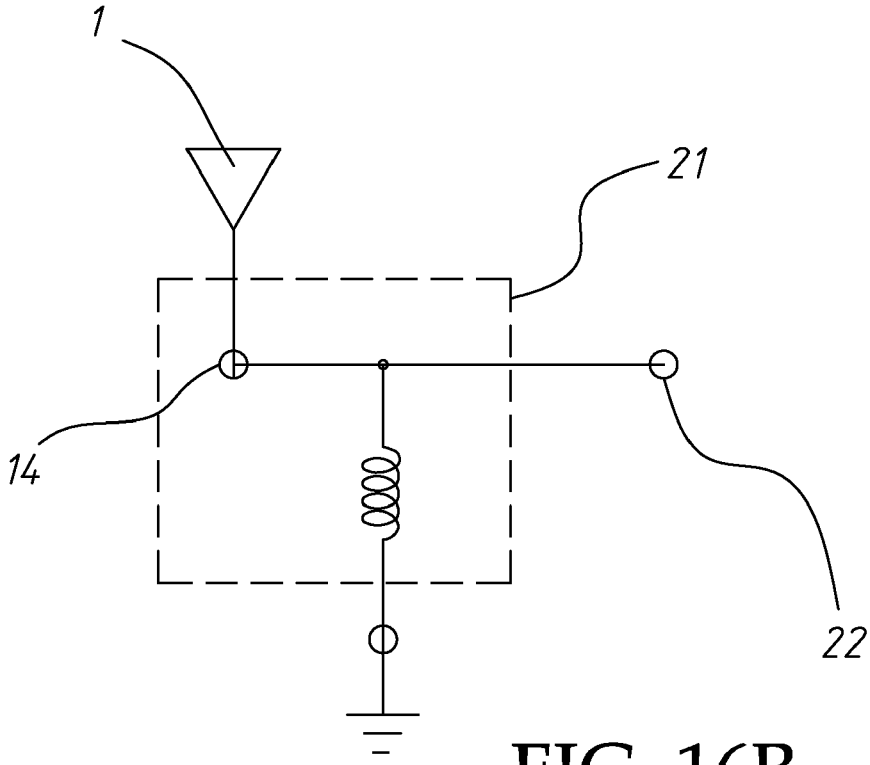
FIG. 16B is a chart showing an electric circuit of FIG. 16.
Figure 17:
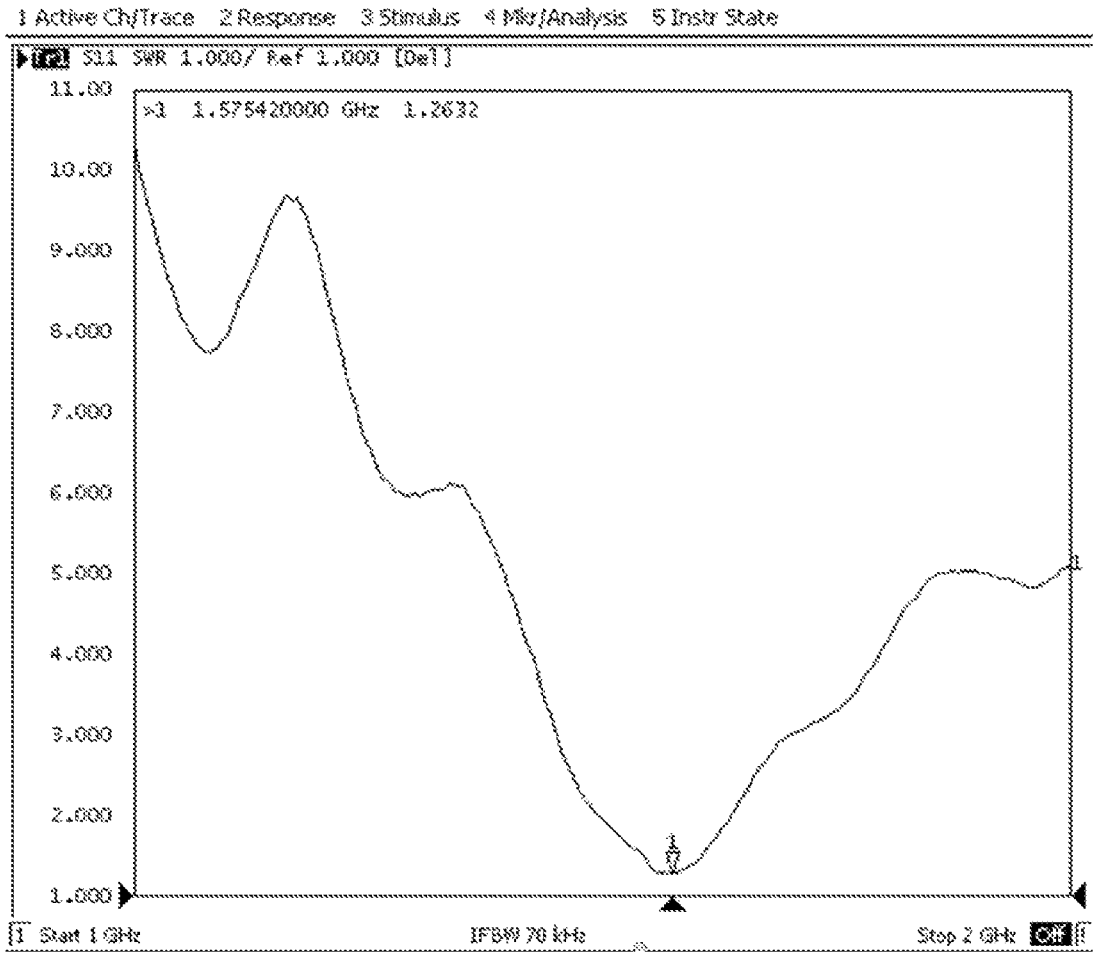
FIG. 17 is a chart showing a standing wave voltage ratio curve of a tested antenna in FIG. 16.

Referring together to FIGS. 14 and 14A, they show an example that the multifunctional antenna chip 1 of the present invention is mounted in a monitor of a notebook to be applied to WLAN. FIG. 14B is a chart showing an electric circuit of the example, the multifunctional antenna chip 1 is connected with an LC matched circuit 21 having thereon a feed-in point 22. Wherein the capacitance value is 0.5 pF, and the inductance value is 1.5 nH, the test frequencies are WLAN (2400 MHz~2500 MHz and 5100 MHz~5800 MHz). FIG. 15 shows a chart showing a standing wave voltage ratio (VSWR) curve of a tested antenna in FIG. 14, The passive efficiencies for it is as follows:

Referring to FIGS. 16 and 16A, they show an example that the multifunctional antenna chip 1 of the present invention is mounted in a monitor of a notebook 4 to be applied to GPS. FIG. 16B is a chart showing an electric circuit of the example of FIG. 16. The multifunctional antenna chip 1 is connected with a matched circuit 21 having a feed-in point 22; wherein the inductance value of the matched circuit 21 is 2.7 nH, the tested frequency for GPS is 1575.42 MHz. FIG. 17 is a chart showing a standing wave voltage ratio (VSWR) curve of a tested antenna in FIG. 16. The passive efficiencies for it is as follows, the frequency is a good working frequency for GPS and the antenna:

| WLAN Test | | | | | | | | |
|---|---|---|---|---|---|---|---|---|
| | Frequency | | | | | | | |
| | 2400 | 2450 | 2500 | 5150 | 5350 | 5470 | 5725 | 5825 |
| Directivity (dBi) | 2.772 | 2.847 | 3.739 | 6.357 | 7.353 | 7.317 | 6.212 | 5.445 |
| Peak EIRP (dBm) | −0.674 | −1.079 | 0.315 | 4.23 | 6.312 | 5.72 | 3.794 | 1.179 |
| Efficiency (%) | 45.23% | 40.49% | 45.47% | 69.68% | 52.71% | 49.76% | 50.34% | 37.45% |

| GPS Test | | | |
|---|---|---|---|
| | Frequency | | |
| | 1574 | 1575 | 1576 |
| Directivity (dBi) | 1.89 | 1.881 | 1.937 |
| Peak EIRP (dBm) | −0.332 | −0.363 | −0.312 |
| Efficiency (%) | 59.95% | 59.63% | 59.% |

In the above two examples, the values of capacitance and inductance in the matched circuit will change following change of the environment in the communication product, they are not limited to the above list. Designing of the matched circuit also follows the change of the environment in the communication product, the electronic elements used can be chosen from the group including capacitors, inductors, adjustable capacitors, inductors and switches etc.

Accordingly, the present invention can use a multifunctional antenna chip to mate with many kinds of matched circuits in accordance with the communication standards required; thereby the multifunctional antenna chip of the present invention can be used for many kinds of communication products such as mobile phones, notebooks, net cards, GPSs etc. The multifunctional antenna chip of the present invention at least has the following advantages:

1. being a standardized product (to be convenient for designing communication products);
2. being packed on a material tape, and having SMD connecting pins (taking advantage of the mode of SMT, in order that products can be mass produced);
3. flexible application (matched circuits can be used for various communication standards or the antenna structure can be changed for adjustment);
4. completion of product manufacturing being able to be speeded up;
5. the matched circuits being adapted to using various electronic elements (including capacitors, inductors, adjustable capacitors or inductors, switches etc.);
6. four connecting pins being able all of RF signal inputting pins (for the convenience of laying out);
7. being easy to combine with an FPC soft board or a PCB board in a product, the designer of products being able of having quite wide dominance.

The preferred embodiments disclosed above are only for illustrating the present invention, and not for giving any limitation to the scope of the present invention. It will be apparent to those skilled in this art that various equivalent modifications or changes made to the elements of the present invention without departing from the spirit of this invention shall fall within the scope of the appended claims and are intended to form part of this invention.

The invention claimed is:

1. A multifunctional antenna chip mounted on an electric circuit board provided with a matched circuit for transmitting radio frequency signals, comprising:

a packing housing;

at least a dielectric layer base board provided in said packing housing and having a plurality of via holes;

an antenna structure at least includes an upper metallic layer and a lower metallic layer respectively allocated on an upper surface and a bottom surface of said dielectric layer base board;

said upper metallic layer and said lower metallic layer are connected with each other by said via holes to form a folded antenna structure; and four connecting pins extended in said dielectric layer base board from four corners of said packing housing to connect said lower metallic layer;

after passing said matched circuit, radio frequency signals enter said antenna structure via one of a plurality of signal input connecting pins to form a mono-pole antenna, a character thus is provided that said antenna structure being adjusted by said matched circuit to render said antenna structure to have a working frequency meeting communication standard.

2. The multifunctional antenna chip as defined in claim 1, wherein another non-signal inputting connecting pin is connected to ground to transform said antenna structure into a plane inverted "F" antenna (PIFA) structure or an inverted "F" antenna (IFA) structure.

3. The multifunctional antenna chip as defined in claim 1, wherein said electric circuit board is provided thereon with a metallic wire segment of an antenna which is connected to a further non-signal inputting connecting pin to thereby change style of said antenna structure.

4. The multifunctional antenna chip as defined in claim 1, wherein multiple layers of said at least a dielectric layer base board are piled, every two of said dielectric layer base boards have therebetween a middle metallic layer, said two dielectric layer base boards are connected by means of a plurality of via holes with said upper metallic layer and said lower metallic layer respectively.

5. The multifunctional antenna chip as defined in claim 1, wherein electronic elements used in said matched circuit are chosen from a group including capacitors, inductances, adjustable capacitors, adjustable inductances or switches.

6. The multifunctional antenna chip as defined in claim 1, wherein said multifunctional antenna chip has a size 22.2×7.2×2.55 $mm^3$.

* * * * *